US007256536B2

(12) United States Patent
Di Domenico et al.

(10) Patent No.: US 7,256,536 B2
(45) Date of Patent: Aug. 14, 2007

(54) CATHODE RAY TUBES

(75) Inventors: Gildo Di Domenico, Colleferro (IT); Paolo Romani, Paliano (IT); Ivano Domenicali, Gavignano (IT)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/542,241

(22) PCT Filed: Dec. 23, 2003

(86) PCT No.: PCT/FR03/50210

§ 371 (c)(1),
(2), (4) Date: Apr. 13, 2006

(87) PCT Pub. No.: WO2004/066343

PCT Pub. Date: Aug. 5, 2004

(65) Prior Publication Data

US 2006/0208622 A1 Sep. 21, 2006

(30) Foreign Application Priority Data

Jan. 17, 2003 (IT) ..... MI2003A0068

(51) Int. Cl.
*H01J 29/00* (2006.01)

(52) U.S. Cl. ..... 313/477 R; 313/479

(58) Field of Classification Search ..... 313/477 R, 313/479, 477 HC
See application file for complete search history.

(56) References Cited

U.S. PATENT DOCUMENTS

| | | | | |
|---|---|---|---|---|
| 3,996,491 | A | 12/1976 | Larson et al. | |
| 4,564,786 | A * | 1/1986 | Baum et al. | 313/479 |
| 5,689,157 | A | 11/1997 | Jitsukata et al. | |
| 6,043,599 | A | 3/2000 | Nakane | |
| 6,515,411 | B1 * | 2/2003 | Bae | 313/479 |
| 6,800,994 | B2 * | 10/2004 | Bartch et al. | 313/479 |

OTHER PUBLICATIONS

Search Report dated Dec. 17, 2004.

* cited by examiner

*Primary Examiner*—Ashok Patel
(74) *Attorney, Agent, or Firm*—Joseph J. Laks; Harvey D. Fried; Richard LaPeruta

(57) ABSTRACT

Cathode-ray tube comprising a glass envelope composed of a substantially rectangular faceplate, of a flared rear part and of a substantially cylindrical neck, the flared part including an anode button for receiving the high voltage, the outer surface of the said flared part being partially covered by an electrically conducting layer, adhering to the said outer surface, the electrically conducting layer being a metallic layer composed mainly of aluminium. This layer makes it possible to improve the image distortions due to the drop in the high voltage during current spikes delivered by the high voltage.

6 Claims, 1 Drawing Sheet

CATHODE RAY TUBES

Figure 1:
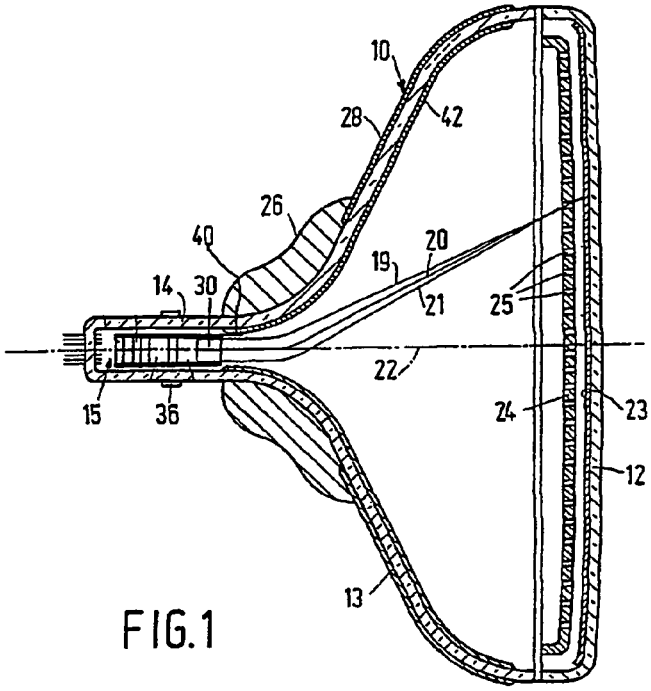

This application claims the benefit, under 35 U.S.C. § 365 of International Application PCT/FR2003/050210, filed Dec. 23, 2003, which was published in accordance with PCT Article 21(2) on Aug. 5, 2004 in French and which claims the benefit of Italian patent application No. MI2003A000068, filed on Jan. 17, 2003.

The subject of the present invention is a display device such as a cathode-ray tube and more especially a resistive coating disposed on the rear part of the tube.

A display device such as a television cathode-ray tube comprises a glass envelope composed of a faceplate and of a funnel-shaped rear part. When the tube is of the type intended to reproduce color images, a luminescent screen is disposed on the inner surface of the faceplate, the said screen comprising three phosphor grids corresponding to the three primary colors red, green and blue. An electron gun is disposed to the rear of the tube so as to generate one or more beams intended to scan the screen under the influence of magnetic fields created by a deflection device disposed on the tube at the exit of the electron gun.

The faceplate and the rear part are sealed together by virtue of a glass frit bead disposed on the coinciding edges, the assembly being treated in a high-temperature furnace so as to melt the glass frit in order to seal the two parts.

The sealing zone is usually covered by a metallic hoop which puts the front zone of the glass envelope into compression, so as to avoid the risk of implosion of the tube during its operation at the end-user's premises.

The rear part of the tube is coated with a first inner conducting layer, and partially with a second outer conducting layer. The inner layer serves as electrical connection between the last electrode of the electron gun and the screen on which the electrons of the electron beam or beams will land. This conducting layer creates a space inside the tube which is thus shielded with respect to electric fields, in which space the electron beam or beams therefore undergo no deflection.

When the tube is operating, the outer conducting layer is earthed, and forms together with the inner layer a capacitor whose objective is to smooth the high voltage applied to the tube by capacitive effect. The earth connection is effected by virtue of one or more conducting bands linking the outer layer to the anti-implosion metallic band encircling the tube, the latter band itself being linked to the earth potential. For a cathode-ray tube of the currently manufactured generation, the capacitance of the filtering capacitor produced by the inner and outer conducting layers typically lies in the range from 1,000 to 3,000 picofarads, and is variable as a function of the size of the tube.

The outer conducting layer is generally produced from a mixture of graphite powder with vinyl compounds so as to form a solution; the graphite ensures electrical conduction and the vinyl compounds ensure cohesion of the mixture and adherence to the surface of the tube. The solution obtained is then deposited by virtue of a brush on the surface of the flared rear part of the tube, leaving a coating-free window around the anode button intended to establish the high-voltage electrical connection with the interior coating. The graphite layer is then dried by a current of hot air for 10 to 15 minutes.

The linear resistance of the layer is generally greater than 50 Ohm/cm; the high voltage applied to the tube sees the capacitor that the inner and outer conducting layers represent in series with the resistance constituted by the graphite layer. The value of this resistance is taken into account in the time constant of the RC circuit represented by the graphite layers, thereby directly influencing the capacity of the high-voltage supply circuit to respond to abrupt current spikes. If the resistance of the graphite layer is too big, the high voltage will drop with each big demand for current, resulting in distortions of the image reproduced on the screen of the tube.

The production of the outer graphite layer exhibits multiple drawbacks from an industrial standpoint:

- preparation, manipulation and maintenance of very soiling solution; the instruments required for the deposition of the graphite layer, the site on which this deposition is performed requires constant and complex cleaning.
- the thickness of the layer is difficult to control owing to the brush-assisted application process; this results in thickness variations which cause considerable local variations in the resistance of the said layer.
- the drying of the layer requires a manufacturing process step which is expensive in terms of energy and tube manufacturing time.
- during the life of the tube, a layer of dust is deposited on parts of the tube following imperfect earthing.

The invention proposes to afford a solution for improving the situation brought about by the graphite layer deposited according to the state of the art, solution making it possible also to obtain better behaviour of the tube during the current spikes demanded of the high voltage.

To this end, the cathode-ray tube according to the invention comprises a glass envelope composed of a substantially rectangular faceplate, of a flared rear part and of a substantially cylindrical neck, the flared part including an anode button for receiving the high voltage, the outer surface of the said flared part being partially covered by an electrically conducting layer, adhering to the said outer surface, characterized in that the electrically conducting layer is a metallic layer whose electrical resistance is less than 1 Ohm per centimetre.

The invention, its various embodiments and its various advantages will be better understood with the aid of the following description and of the drawings, among which:

FIG. 1 is a sectional view of a cathode-ray tube according to the invention

Figure 2A:
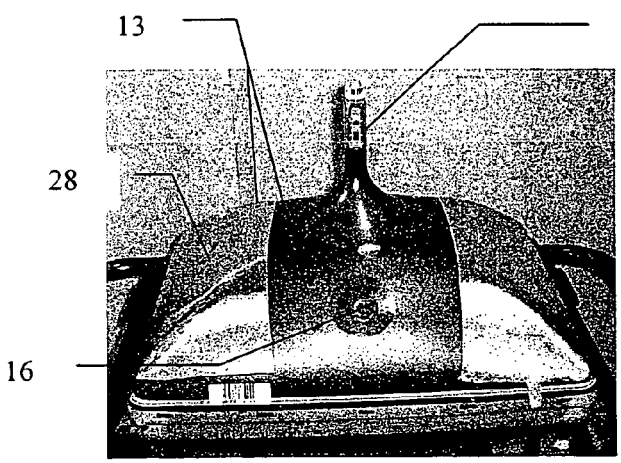

FIGS. 2*a* et 2*b* show in isometric projection the flared rear part mounting a conducting coating according to the invention.

The cathode-ray tube illustrated by FIG. 1 is of the type to generate a color image; it comprises a glass envelope 10 which is composed of a faceplate 12, a flared rear part 13, in the form of a funnel, and of a substantially cylindrical neck 14. An electron gun 15 is disposed in the neck 14 and generates one or more generally coplanar electron beams 19,20,21, the axis of the gun coinciding with the longitudinal axis 22 of the tube. The faceplate 12 comprises an inner surface forming a luminescent screen 23 on which are deposited phosphor grids emitting in the three primary colors, red, green and blue respectively, so as to reproduce a color image. Facing the screen 23 has been disposed a color selection mask 24 on which are made multiple apertures 25, which may for example be of elongate form and disposed in vertical lines, each electron beam (19,20,21) passing through the mask through these apertures so as to illuminate the phosphor grid corresponding thereto. The electron beams scan the entire image screen 23 by virtue of a magnetic deflection created by a deflection device 26, also called a deflector. The deflector is arranged on the rear part of the tube, in proximity to the zone of exit of the electron beams of the gun.

A conducting layer 42 is disposed inside the tube, on the inner surface of the flared rear part, which layer is brought to the high anode voltage of the exterior by virtue of an anode button 16 passing through the thickness of the flared rear part. The high voltage is conveyed to the electron gun by a spring 40 connected to an electrode of the gun, which spring comes into contact with the conducting layer 42.

A conducting layer 28 is deposited on a zone partially occupying the outer surface of the flared rear part 13. During the operation of the tube this conducting layer is maintained at the earth potential by virtue for example of electrical links with the metallic anti-implosion hoop disposed around the zone where the faceplate is sealed to the flared rear part, anti-implosion hoop connected to the earth of the high-voltage supply. The outer conducting layer avoids the zone situated around the anode button so as not to have two zones close to one another brought to different potentials of several tens of kilovolts.

According to the invention the outer conducting layer is produced by glueing a highly conducting metallic film to the flared rear part. This structure has been chosen since numerous metals are available nowadays in very thin film form which can easily be cut and used for application to the surface of the tube. Furthermore these films are of constant thickness thereby allowing better control than in the past of the uniformity of the surface resistance of the said film.

With the application of thin metallic films it is possible to lower the linear resistance of the outer conductive film 28 to values below 1 Ohm per centimetre and to do so over the whole of the zone where the film is deposited. Thus it is possible to lower the time constant of the RC circuit seen by the high-voltage supply, while retaining the same value of the capacitance C of the capacitor produced by the outer 28 and inner 42 conducting layers deposited on the surfaces of the flared rear part of the tube.

In a first embodiment of the invention, the outer surface of the rear part of the tube is glued, for example with the aid of an adhesive spray and the metallic film 28, previously cut to the dimensions of the tube, is applied to the part smeared with adhesive.

In a second embodiment of the invention, use is made of a metallic film previously smeared on one of its faces with a layer of adhesive, thereby making it possible to fix the metallic film simply by contact with the surface of the flared part of the tube; this makes it possible not to have to handle glue in the tube-manufacturing plant, glue being a soiling material, making it necessary to carry out considerable maintenance of the tools required for its handling and for its deposition; moreover the use of metallic film previously smeared with adhesive decreases the time required for obtaining a film adhering to the surface of the tube and hence the total manufacturing time of the said tube.

In a third embodiment of the invention the metallic layer is produced by vacuum evaporation. The rear of the tube is deposited in an enclosure in such a way that the periphery of the enclosure hugs the periphery of the tube. A specified quantity of metal is vapourized in a conventional manner inside the previously evacuated enclosure, and is deposited on the rear part of the tube which is thereby metallized. A mask may have preferably been disposed on the rear part of the tube so as to avoid the metallization of certain zones, such as that surrounding the anode button 16, which mask is removed after the metallization. The quantity of vapourized matter determines the thickness of the layer produced and hence its resistive properties.

Various metals may advantageously be used within the framework of the invention, however aluminium has been chosen by preference since the industry for this metal allows easy availability of a low-cost raw material.

Furthermore aluminium has numerous advantages in the cathode-ray tube manufacturing industry; apart from the fact that its low resistivity, of the order of 2.5 $10^{-8}$ Ohm.m makes it possible to address the essential characteristic of the invention, aluminium is a material which does not corrode, a requirement which is necessary to ensure the performance of the tube over time.

Furthermore aluminium is a light metal and this contributes to lightening the weight of the tube which is an important criterion nowadays owing to the fact that the dimensions of current tubes are tending to become ever bigger.

The cathode-ray tube industry is nowadays finding itself confronted with the requirements for safeguarding the environment and, within this framework, aluminium has the advantage of being 100% recyclable.

Aluminium can be employed in all the embodiments of the invention; it is available industrially in the form of thin films, pre-glued or otherwise, and it can easily be sublimated in vacuum enclosures in order to aluminize a specified surface.

Within the framework of the invention, the metallic film 28 deposited on the outer surface of the rear part of the tube is composed mainly of aluminium whose thickness is preferably less than 150 μm so as to obtain a metallized layer whose linear resistance is less than 0.5 Ohms per centimetre.

Figure 2B:
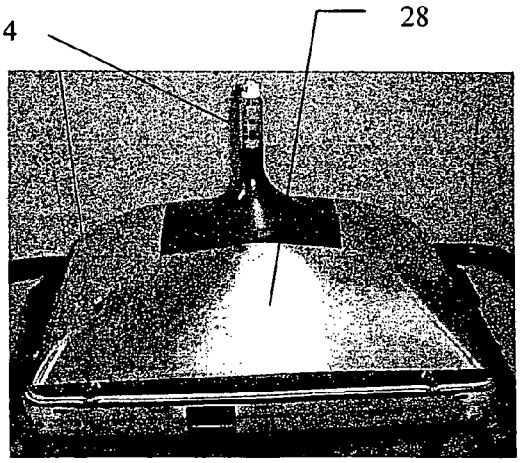

In the example illustrated by FIGS. 2A and 2B the aluminium layer chosen is 60 μm thick thereby making it possible to obtain a linear resistance of 0.1 Ohms per centimetre.

The examples above are not limiting. The metal chosen to produce the metallic layer may be any metal whose resistivity is sufficiently low to obtain the desired linear resistance, less than 1 Ohm per centimetre, as a thin layer. They may be aluminium alloys or metals whose resistivity is preferably below $10^{-7}$ Ohm.m.

The other essential criterion is that the deposited layer does not corrode so as to ensure its electrical characteristics throughout the lifetime of the tube; this characteristic can be obtained either through the intrinsic qualities of the metal chosen, or with the aid of a suitable treatment of the metallic layer deposited on the tube.

The invention claimed is:

1. Cathode-ray tube comprising a glass envelope composed of a substantially rectangular faceplate, of a flared rear part and of a substantially cylindrical neck, the flared part including an anode button for receiving a high voltage supplying the tube, the outer surface of the said flared part being partially covered by an electrically conducting layer, adhering to the said outer surface, characterized in that the electrically conducting layer is a metallic layer whose linear electrical resistance is less than 1 Ohm per cm.

2. Cathode-ray tube according to claim 1, wherein the outer metallic layer is composed mainly of aluminium.

3. Cathode-ray tube according to claim 2, wherein the electrical resistance of the outer metallic layer is less than 0.5 Ohms per cm.

4. Method of manufacturing a cathode-ray tube in accordance with claim 1, comprising the following steps:

deposition of an adhesive layer on the flared rear part of the tube, deposition on the adhesive of a conducting metallic film.

5. Cathode-ray tube according to claim 1, wherein the metallic layer is produced from a metallic film previously glued prior to its deposition on the flared rear part of the tube.

6. Cathode-ray tube according to claim 1, wherein the metallic layer is produced by vacuum evaporation of a conducting metal whose resistivity is less than $10^{-7}$ Ohm.m.

* * * * *